US008616417B2

(12) United States Patent
Neuhaus

(10) Patent No.: US 8,616,417 B2
(45) Date of Patent: Dec. 31, 2013

(54) VALVE AND DISCHARGE DEVICE

(75) Inventor: Reinhard Neuhaus, Hemer (DE)

(73) Assignee: Aptar Dortmund GmbH, Dortmund (DE)

( * ) Notice: Subject to any disclaimer, the term of this patent is extended or adjusted under 35 U.S.C. 154(b) by 0 days.

(21) Appl. No.: 13/380,293

(22) PCT Filed: Jun. 4, 2010

(86) PCT No.: PCT/EP2010/003379

§ 371 (c)(1),
(2), (4) Date: Dec. 22, 2011

(87) PCT Pub. No.: WO2010/149264

PCT Pub. Date: Dec. 29, 2010

(65) Prior Publication Data

US 2012/0111898 A1 May 10, 2012

(30) Foreign Application Priority Data

Jun. 25, 2009 (DE) ..... 10 2009 030 627

(51) Int. Cl.
*B65D 83/00* (2006.01)
*B65D 5/72* (2006.01)

(52) U.S. Cl.
USPC ..... 222/402.13; 222/494

(58) Field of Classification Search
USPC ..... 222/402.13, 402.1, 402.2, 402.11, 222/402.14, 402.22, 494, 212, 209, 207, 222/402.21, 490; 239/337
See application file for complete search history.

(56) References Cited

U.S. PATENT DOCUMENTS

| | | | |
|---|---|---|---|
| 1,881,488 | A | 10/1932 | Gleason |
| 2,500,687 | A | 3/1950 | Kamp et al. |
| 2,714,475 | A | 8/1955 | Roehrich |
| 2,721,010 | A | 10/1955 | Meshberg |
| 2,736,930 | A | 3/1956 | Longley |
| 2,772,819 | A | 12/1956 | Poarch et al. |
| 2,812,884 | A | 11/1957 | Ward |
| 2,837,249 | A | 6/1958 | Meshberg |
| 2,884,164 | A | 4/1959 | Kleid |
| 2,980,301 | A | 4/1961 | Gorter |
| 3,018,928 | A | 1/1962 | Meshberg |
| 3,073,489 | A | 1/1963 | Friedman |

(Continued)

FOREIGN PATENT DOCUMENTS

| | | |
|---|---|---|
| DE | 2043415 | 9/1970 |
| DE | 2920497 | 11/1980 |

(Continued)

OTHER PUBLICATIONS

Written Opinion for International Patent Application No. PCT/EP2010/003379, mailed Sep. 16, 2010.

(Continued)

*Primary Examiner* — Kevin P Shaver
*Assistant Examiner* — Stephanie E Williams
(74) *Attorney, Agent, or Firm* — Jason H. Vick; Sheridan Ross, PC

(57) ABSTRACT

Proposed are an outlet valve and a dispensing device with an outlet valve for a cosmetic liquid. The outlet valve has a flatly resting valve element with an outlet formed therein. The outlet valve is able to open through the elastic deformation of the valve element.

44 Claims, 4 Drawing Sheets

(56) References Cited

U.S. PATENT DOCUMENTS 3,104,785 A 9/1963 Beard, Jr.
3,131,834 A 5/1964 Meshberg
3,154,224 A 10/1964 Wakeman
3,155,291 A 11/1964 Wakeman
3,162,333 A 12/1964 Davidson
3,258,369 A 6/1966 Blaich
3,286,885 A 11/1966 Huling
3,323,695 A 6/1967 Monahon
3,337,096 A 8/1967 Brown
3,385,482 A 5/1968 Frangos
3,507,586 A 4/1970 Gronemeyer et al.
3,511,418 A 5/1970 Venus, Jr.
3,542,253 A 11/1970 Weber et al.
3,608,830 A 9/1971 Ramella
3,642,179 A 2/1972 Micallef
3,672,543 A 6/1972 Roper et al.
3,698,961 A 10/1972 Niemann
3,705,667 A * 12/1972 Blanie et al. ..... 222/136
3,706,393 A 12/1972 Curtis et al.
3,726,442 A 4/1973 Davidson et al.
3,795,350 A 3/1974 Shay
3,796,356 A 3/1974 Venus, Jr.
3,918,615 A 11/1975 Morane
3,931,831 A 1/1976 French
3,961,725 A 6/1976 Clark
3,991,916 A 11/1976 Del Bon
4,035,303 A 7/1977 Ufferfilge
4,099,651 A 7/1978 Von Winckelmann
4,222,501 A 9/1980 Hammett et al.
4,304,749 A 12/1981 Bauer
4,352,443 A 10/1982 Libit
4,387,833 A 6/1983 Venus, Jr.
4,393,984 A * 7/1983 Debard ..... 222/402.18
4,416,602 A 11/1983 Neumeister
4,423,829 A 1/1984 Katz
4,458,832 A 7/1984 Corsette
4,493,444 A 1/1985 Del Bon et al.
4,506,808 A 3/1985 Goncalves
4,513,890 A 4/1985 Goncalves
4,564,130 A 1/1986 Eulenburg
4,830,229 A 5/1989 Ball
4,867,347 A 9/1989 Wass et al.
4,875,604 A 10/1989 Czech
4,892,231 A 1/1990 Ball
4,919,312 A 4/1990 Beard et al.
4,946,076 A 8/1990 Hackmann et al.
4,964,852 A 10/1990 Dunning et al.
4,969,577 A 11/1990 Werding
5,007,556 A 4/1991 Lover
5,007,596 A 4/1991 Iwahashi
5,096,098 A 3/1992 Garcia
5,139,201 A * 8/1992 De Laforcade ..... 239/343
5,197,637 A 3/1993 Naumann
5,221,724 A 6/1993 Li et al.
5,244,128 A 9/1993 De Laforcade
5,271,432 A 12/1993 Gueret
5,273,191 A * 12/1993 Meshberg ..... 222/105
5,301,850 A 4/1994 Gueret
5,305,930 A 4/1994 De Laforcade
5,340,031 A * 8/1994 Neuhaus et al. ..... 239/343
5,360,145 A 11/1994 Gueret
5,413,250 A 5/1995 Gueret
5,454,488 A 10/1995 Geier
5,465,872 A 11/1995 Gueret
5,492,252 A 2/1996 Gueret
5,505,341 A 4/1996 Gueret
5,509,582 A 4/1996 Robbins, III
5,588,565 A 12/1996 Miller
5,622,284 A 4/1997 Sawicki
5,649,645 A 7/1997 Demarest et al.
5,687,884 A 11/1997 Bodin et al.
5,728,333 A 3/1998 Tabata et al.
5,732,855 A 3/1998 Van der Heijden
5,743,441 A 4/1998 Baudin et al.
5,769,283 A 6/1998 Owada et al.
5,857,224 A 1/1999 Oberg et al.
5,862,955 A 1/1999 Albini et al.
5,868,287 A 2/1999 Kurolkawa et al.
5,873,491 A 2/1999 Garcia et al.
5,875,936 A 3/1999 Turbett et al.
5,875,939 A 3/1999 Geier
5,881,929 A 3/1999 Coerver, Jr.
5,927,568 A 7/1999 De Nervo et al.
5,975,381 A 11/1999 Revenu
6,007,914 A 12/1999 Joseph et al.
6,083,450 A 7/2000 Safian
6,112,953 A 9/2000 Gueret
6,116,475 A 9/2000 Delage
6,126,044 A 10/2000 Smith
6,145,707 A 11/2000 Baudin
6,216,916 B1 4/2001 Maddox et al.
6,227,417 B1 * 5/2001 De LaForcade et al. ... 222/321.9
6,234,363 B1 5/2001 Stradella
6,298,960 B1 10/2001 Derr
6,322,542 B1 11/2001 Nilson et al.
6,328,920 B1 12/2001 Uchiyama et al.
6,352,184 B1 3/2002 Stern et al.
6,382,469 B1 5/2002 Carter et al.
6,405,898 B1 6/2002 O'Connor et al.
6,589,216 B1 7/2003 Abbott et al.
6,622,893 B2 9/2003 Leone et al.
6,629,799 B2 10/2003 Flores, Jr.
6,756,004 B2 6/2004 Davis et al.
6,778,089 B2 8/2004 Yoakum
6,832,704 B2 12/2004 Smith
6,919,114 B1 7/2005 Darras et al.
6,966,465 B2 11/2005 Kang
7,040,514 B2 5/2006 Colan et al.
7,104,424 B2 9/2006 Kolanus
7,264,142 B2 9/2007 Py
7,464,839 B2 12/2008 Heukamp
7,523,845 B2 4/2009 Eberhardt
7,637,399 B2 12/2009 Marroncles et al.
7,748,647 B2 * 7/2010 Clerget et al. ..... 239/337
7,780,045 B2 8/2010 Rossignol
7,854,355 B2 12/2010 Rossignol
7,934,667 B2 * 5/2011 Westrich ..... 239/337
8,109,412 B2 2/2012 Decottignies et al.
2002/0037179 A1 3/2002 Suzuki et al.
2002/0051314 A1 5/2002 Hayashi
2002/0074355 A1 6/2002 Lewis et al.
2002/0190085 A1 12/2002 Stanford
2003/0071080 A1 4/2003 Yquel
2003/0071085 A1 4/2003 Lasserre et al.
2003/0230603 A1 12/2003 Smith
2005/0098584 A1 5/2005 Do Rosario
2005/0115984 A1 * 6/2005 Pritchett et al. ..... 222/95
2005/0155980 A1 7/2005 Neuhalfen
2006/0060618 A1 3/2006 Hoepner et al.
2006/0186139 A1 8/2006 Laidler et al.
2006/0231519 A1 10/2006 Py et al.
2007/0228082 A1 10/2007 Jasper et al.
2007/0272767 A1 11/2007 Niggemann
2008/0099514 A1 5/2008 Carter et al.
2008/0110941 A1 5/2008 Foster et al.
2008/0197152 A1 8/2008 Neuhaus et al.
2009/0166383 A1 7/2009 Canfield
2009/0212075 A1 8/2009 Neuhaus et al.
2009/0236373 A1 9/2009 Laib et al.
2009/0294480 A1 12/2009 Canfield
2009/0314810 A1 12/2009 Neuhaus
2010/0012680 A1 1/2010 Canfield et al.
2010/0038385 A1 2/2010 Jasper
2010/0108722 A1 5/2010 Canfield et al.
2010/0147898 A1 6/2010 Blumenstein et al.
2010/0200616 A1 8/2010 Decottignies
2010/0206911 A1 8/2010 Bernhard
2010/0252577 A1 10/2010 Neuhaus et al.
2010/0308077 A1 12/2010 Sonntag
2011/0309112 A1 12/2011 Jordan

(56) References Cited

U.S. PATENT DOCUMENTS

FOREIGN PATENT DOCUMENTS

| | | |
|---|---|---|
| DE | 9307083 | 7/1993 |
| DE | 4210225 | 9/1993 |
| DE | 19851659 | 11/1998 |
| DE | 29820894 | 1/1999 |
| DE | 19744510 | 4/1999 |
| DE | 19832824 | 2/2000 |
| DE | 19950512 | 5/2001 |
| DE | 20203841 | 6/2002 |
| DE | 10308727 | 6/2004 |
| DE | 202004011219 | 11/2004 |
| DE | 202004011220 | 11/2004 |
| DE | 20200512684 | 11/2005 |
| DE | 10 2007 049614 A1 | 9/2008 |
| EP | 0058700 | 9/1982 |
| EP | 0069738 | 1/1983 |
| EP | 0179538 | 4/1986 |
| EP | 0320510 | 6/1989 |
| EP | 0442858 | 8/1991 |
| EP | 0599301 | 6/1994 |
| EP | 0864371 | 9/1998 |
| EP | 0893356 | 1/1999 |
| EP | 0908395 | 4/1999 |
| EP | 0930102 | 7/1999 |
| EP | 1084669 | 3/2001 |
| EP | 0954485 | 1/2002 |
| EP | 1327478 | 7/2003 |
| EP | 1637232 | 3/2006 |
| FR | 1266391 | 7/1961 |
| FR | 2127774 | 10/1972 |
| FR | 2510069 | 1/1983 |
| FR | 2654079 | 11/1989 |
| FR | 2783667 | 3/2000 |
| FR | 2838108 | 10/2003 |
| GB | 1405546 | 8/1972 |
| GB | 1523732 | 9/1978 |
| GB | 2083142 | 3/1982 |
| GB | 2105729 | 3/1983 |
| GB | 2150226 | 6/1985 |
| GB | 2155435 | 9/1985 |
| GB | 2161222 | 1/1986 |
| JP | 07251884 | 3/1995 |
| JP | 09039467 | 2/1997 |
| WO | WO 96/16746 | 6/1996 |
| WO | WO 00/26007 | 5/2000 |
| WO | WO 00/44505 | 8/2000 |
| WO | WO 01/25116 | 4/2001 |
| WO | WO 02/48004 | 6/2002 |
| WO | WO 02/079679 | 10/2002 |
| WO | WO 2004/022143 | 3/2004 |
| WO | WO 2004/073871 | 9/2004 |
| WO | WO 2004/073877 | 9/2004 |
| WO | WO 2005/000731 | 1/2005 |
| WO | WO 2005/123542 | 12/2005 |
| WO | WO 2005/123543 | 12/2005 |
| WO | WO 2006/123168 | 11/2006 |
| WO | WO 2006/128574 | 12/2006 |
| WO | WO 2007/062824 | 6/2007 |
| WO | WO 2007/104561 | 9/2007 |
| WO | WO 2009/030393 | 3/2009 |

OTHER PUBLICATIONS

International Preliminary Report on Patentability for International Patent Application No. PCT/EP2010/003379, mailed Jan. 17, 2012.

International Search Report prepared by the European Patent Office on Sep. 16, 2010, for International Application No. PCT/EP2010/003379.

U.S. Appl. No. 13/663,009, filed Oct. 29, 2012, Neuhaus.

U.S. Appl. No. 12/600,219, filed Mar. 13, 2010, Canfield et al.

U.S. Appl. No. 13/529,109, filed Jun. 21, 2012, Canfield.

Wacker Silicones, Geniomer® 200 Thermoplastic Silicone Elastomer, Jan. 10, 2005, XP002394023, retrieved from Internet address http://www.wacker.com/internet/webcache/en_US?PTM?TM?GENIOMER/GENIOMER_200_e.pdf on Aug. 8, 2006.

* cited by examiner

VALVE AND DISCHARGE DEVICE

CROSS REFERENCE TO RELATED APPLICATIONS

This application is a national stage application under 35 U.S.C. 371 of PCT Application No. PCT/EP2010/003379 having an international filing date of 4 Jun. 2010, which designated the United States, which PCT application claimed the benefit of German Application No. 10 2009 030 627.7 filed 25 Jun. 2009, the entire disclosure of each of which is incorporated herein by reference.

The present invention relates to a valve and a dispensing device for a preferably cosmetic liquid according to the preamble of claims 1 and 15, respectively.

In the present invention, the term "dispensing device" is to be understood particularly as a dispensing head which preferably is or can be mounted on a container or the dispensing valve thereof. In particular, it can also be a pressurized container, a dispenser pump or the like. The dispensing device is preferably used for the non-spraying delivery or dispensing of a preferably cosmetic liquid. However, it can also be a dosing pump or a manually operated pump or any other dispensing device, such as a container, spray head, dispenser or the like, particularly for a cosmetic liquid.

The term "liquid" is to be understood particularly as including suspensions and fluids as well, optionally with gas phases. The liquid can be dispensed as a paste, stream or mist or in another manner, for example as a foam or gel.

Preferably, the dispensing device is used for a cosmetic liquid. The term "cosmetic liquid" is to be understood in a narrower sense as cosmetics, hairspray, hair lacquer, deodorant, shaving foam, color spray, sunscreen or skin care agent, and generally agents for beauty care or the like. Preferably, however, other body or hair care products are also included as well in a broader sense.

For example, the liquid can be cleaning agents or lubricants or other liquids, for example air fresheners, and particularly other technical liquids and fluids as well such as rust removers or the like. Nonetheless, for the sake of simplicity and due to the emphasized use, there is often only mention of cosmetic liquid in the following.

In today's dispensing devices for the dispensing of particularly foaming or foamed liquids such as shaving foam, or in dispenser pumps, there is often the problem that the liquids or products formed from them continue to come out, particularly continue to foam or drip, after completion of the actual dispensing. This problem is particularly blatant in the case of shaving foam or the like but also occurs in non-foamed and non-foaming liquids and can lead, particularly, to undesired soiling of the dispensing devices.

WO 2007/104561 A2 discloses a dispensing device. According to one modification, the dispensing device is embodied as a spray head with an outlet valve to prevent the liquid or foam from continuing to emerge. The outlet valve has an elastically deformable, flat valve element. The valve element is sprayed against a base material, areas of which have been pretreated, and thereby joined to the base material in the pretreated area. The pretreatment is performed through plasma treatment and/or irradiation in order to enable the joining of materials in the desired area which could not otherwise be joined together. Experience has shown that it is very difficult to produce a tight connection of the valve element to the base material and/or to ensure secure closing.

It is the object of the present invention to provide an improved valve and an improved dispensing device, so that very good closing of the valve and/or an especially compact design and/or simple manufacture that is suited to mass production is made possible.

The above object is achieved through a valve according to claim 1 or a dispensing device according to claim 15. Advantageous modifications are the subject of the subclaims.

A first aspect of the present invention is that the valve that particularly forms an outlet valve, especially preferably for a dispensing device, has an outlet which is formed by an elastically deformable valve element for opening the valve. This permits a compact design and an especially defined and reliable closing of the valve. The outlet has a defined position, and very defined delivery characteristics can be achieved.

Especially preferably, the valve element is joined, particularly through molding, in a laminar manner directly to an associated retention section, such as a base material, lower part or the like, a flat connection being prevented in a deformation area by a pretreatment, so that the valve element is able to detach from the detention section and/or deform elastically in this area. The opening of the valve can therefore occur through the lifting-off of the valve element from the retention section at least in areas. Alternatively or in addition, however, the valve can also open as a result of the preferably flat valve element deforming elastically at least substantially in its superficial extension in order to open the preferably slit-like outlet and thus the valve.

Expressed in more general terms, a provision is preferably made that a first material is pretreated in an area and a second material is then molded directly against the first material and thus solidly joined to the first material, the two materials not being joined in the pretreated area and/or preferably being detachable from each other exclusively in the pretreated area. In this manner, it is very easy to enable a detachment of the two materials from each other in the pretreated area and thus, particularly, the opening of the valve.

The pretreatment is performed particularly through the application of a coating, intermediate layer or film, especially preferably an embossing film or heat seal film, that are particularly solidly joined to the retention section and/or are not or cannot be connected to the valve element. This allows for very simple, cost-effective and/or speedy manufacture.

The solution according to the invention permits optimal pairing of materials. In particular, materials can also be used which bond solidly to each other in order to form components that are able to detach partially from each other.

Preferably, the outlet formed in the valve element is transversely offset to the outlet channel formed in the retention section. More or less any offset can be selected. The extent of offset has a substantial impact on the characteristics of the valve. Through appropriate variation of the offset, the desired characteristics can therefore be achieved quite easily.

Moreover, the proposed valve permits many variations in the design of the outlet, for example with respect to number, position, shape and size. Again, different valve characteristics can be achieved quite easily in this manner.

Especially preferably, the proposed valve forms an outlet valve in a dispensing device, particularly in a dispensing head. The valve is very particularly suited here to preventing the liquid or of a product formed by it, such as shaving foam or the like, from continuing to emerge.

According to a second aspect of the present invention which can also be implemented independently, the valve forms an assembly consisting in particular of several components or materials which is built into the dispensing device or into a dispensing head in a prefabricated manner. This allows for particularly favorable mass production or prefabrication of the valve. For example, the same valve can be used for different dispensing devices.

The valve is preferably installed in a clamping or locking manner. Alternatively or in addition, the valve can also be glued in or welded. This allows for simple, cost-effective manufacture.

Further advantages, features, characteristics and aspects of the present invention follow from the claims and the following description of a preferred embodiment on the basis of the drawing.

In the partially not true-to-scale, only schematic figures, the same reference symbols are used for same or similar parts, with corresponding or comparable characteristics and advantages being achieved even if a repeated description is omitted.

Figure 1:
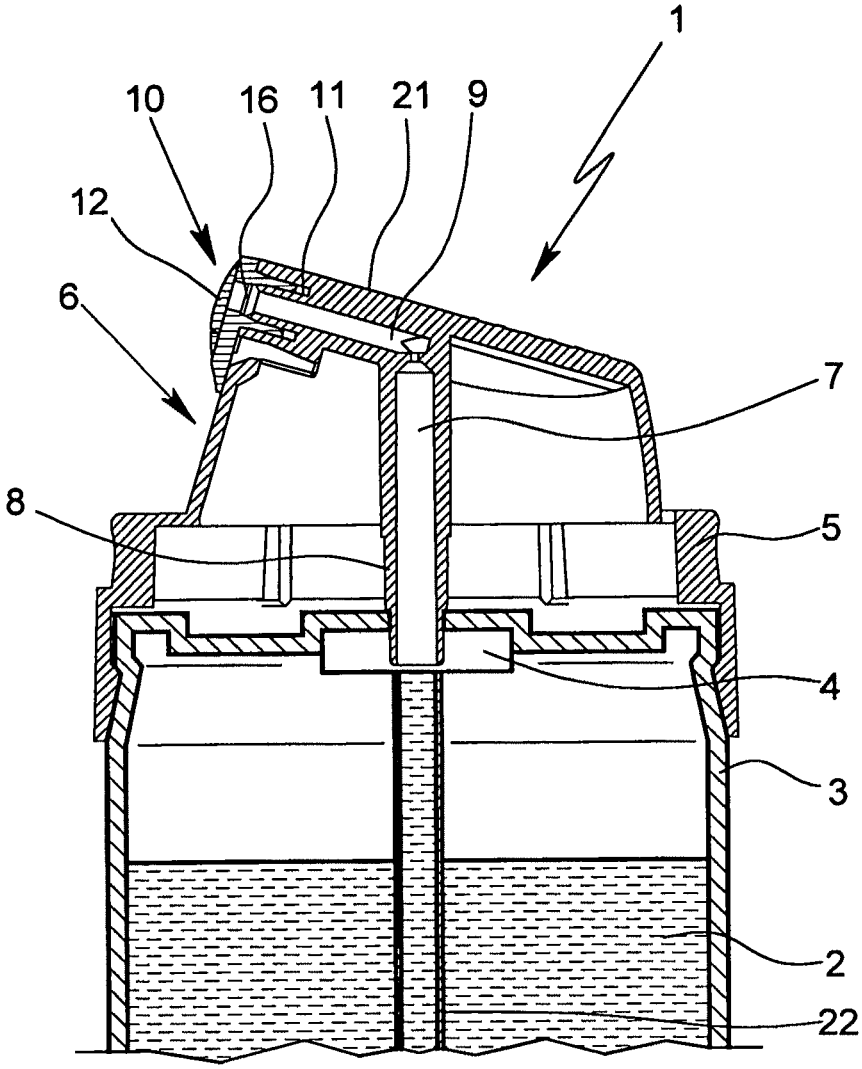
FIG. 1 shows a schematic section of a proposed dispensing device with a container and a proposed valve.

In schematic section, FIG. 1 shows a proposed dispensing device 1 that is preferably embodied as a dispensing head for dispensing a liquid 2 in the sense mentioned at the outset, for example a lotion.

The liquid 2 or a product to be dispensed formed from it can be more viscous than water or even pasty, if necessary. In particular, the liquid 2 can also form a foam or gel. The liquid 2 can also contain gas in liquid and/or another form.

In particular, the dispensing device 1 is designed for the non-spray dispensing of the liquid 2. Particularly, the liquid 2 is dispensed as a foam, preferably as shaving foam or the like. For this purpose, the liquid 2 is particularly designed to be self-foaming and/or it is foamed up during dispensing.

In principle, however, the liquid 2 can also be dispensed in the non-foamed state or, particularly, even be designed to be non-foaming. Moreover, it is also possible that the liquid 2 foams up very little, so that, for example, the foaming merely increases the volume somewhat but a liquid or pasty consistency is essentially maintained during dispensing.

It should be noted that, in principle, instead of the dispensing of the liquid 2 as a foam described for the sake of example, any other dispensing of the liquid 2—as a pasty mass, as a gel, as drops, as a stream or as a spray mist, as needed—is also worthy of consideration.

The dispensing device 1 is preferably provided with or connected to a reservoir, particularly a container 3 for the product 2 to be delivered. The reservoir can therefore form a part of the dispensing device 1 or can be connected or connectable thereto.

In the depicted example, the reservoir is embodied as a preferably rigid container 3, particularly as a pressurized container. The container 3 is particularly oblong and/or cylindrical and/or rigid—especially preferably embodied as a metallic can—for the liquid 2.

The liquid 2 in the reservoir preferably either can be or is pressurized. In particular, the container 3 or the liquid 2 contains a suitable propellant, preferably a volatile and/or flammable propellant, compressed gas and/or carbon dioxide. However, the dispensing device 1 can also form a pump or the like which sucks the liquid 2 particularly from the container 3.

Especially preferably, the container 3 has on its front side a dispensing valve 4 (indicated only schematically) to which the dispensing device 1 or the dispensing head 6 formed by same is or can be connected.

In the depicted example, the dispensing device 1 preferably has a housing part 5 that is or can be connected with the reservoir or container 3, especially preferably placed thereupon in a clamping or locking manner.

The dispensing device 1 also has or forms a dispensing head 6 preferably held and/or formed by the housing part 5, which dispensing head 6 preferably forms a delivery channel 7 and can be or is connected to the dispensing valve 4. In the depicted example, the dispensing head 6 is provided with an appropriate connecting section 8 particularly for pluggable connection to the dispensing valve 4.

In the depicted example, the housing part 5 and the dispensing head 6 are preferably embodied in a single piece, the housing part 5 particularly holding the dispensing head 6 in a tiltable or depressible manner, for example via a film hinge or another, particularly elastically deformable connection section.

The housing part 5 or the dispensing head 6 is preferably injection-molded or made of plastic.

The dispensing device 1 preferably has a valve 10 connected via a connecting channel 9, which valve 10 particularly forms an outlet valve, which is why there is always mention here of the outlet valve.

The outlet valve 10 preferably closes the connecting channel 9 on the outlet side. It should be noted that the outlet valve 10 can also close the delivery channel 7 directly on the outlet side. In this case, the connecting channel 9 can therefore be omitted or formed by the delivery channel 7.

The outlet valve 10 preferably forms an assembly that is particularly installed prefabricated. In the depicted example, the outlet valve 10 is held or accommodated by a recess or receiving notch 11. Preferably, the outlet valve 10 can be accommodated or fastened in a locking or clamping manner by the receiving notch 11. In particular, the outlet valve 10 can be inserted at least partially into the receiving notch 11. Alternatively or in addition, the outlet valve 10 can also be mounted on the dispensing head 6 or the dispensing device 1 through gluing, welding or in another appropriate manner.

Figure 2:
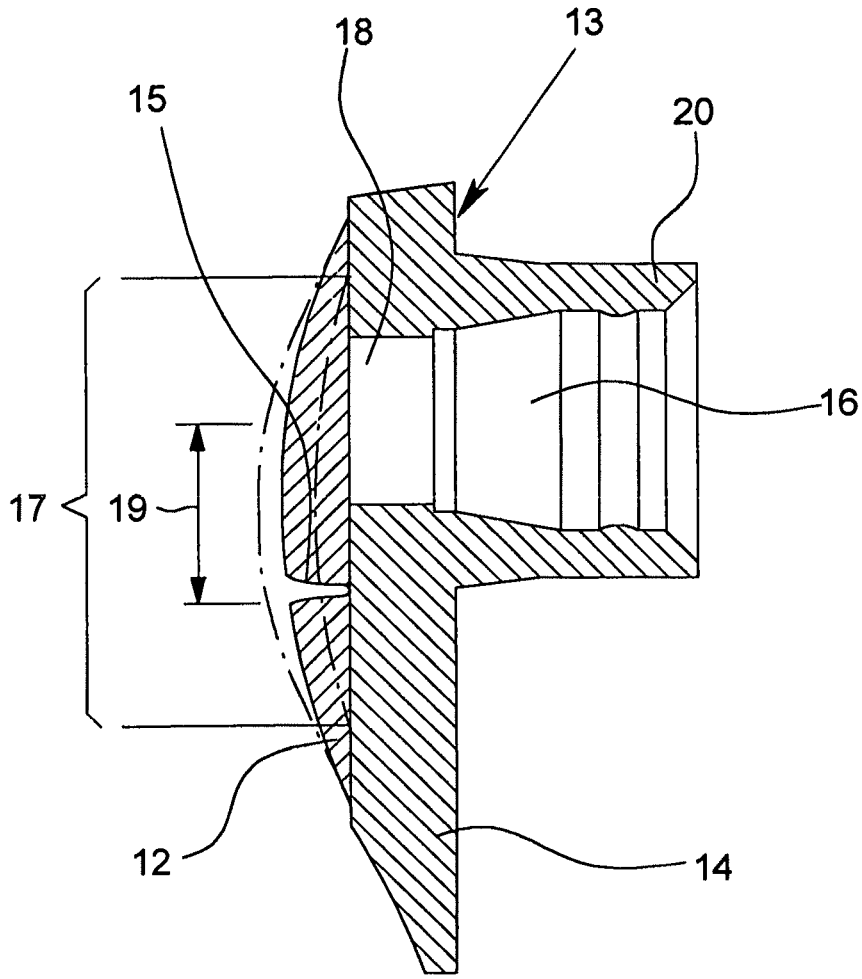
FIG. 2 shows a schematic enlarged section of the valve according to FIG. 1, but without a dispensing device.

In an enlarged sectional illustration, FIG. 2 shows the outlet valve 10 according to FIG. 1, but without dispensing device 1 or dispensing head 6, which is to say the prefabricated assembly that is preferably manufactured separately.

Especially preferably, the outlet valve 10 has a valve element 12 that is at least partially elastically deformable for the purpose of opening and closing the outlet valve 10. The valve element 12 is made of an appropriately elastically deformable material. FIG. 2 shows the outlet valve 10 in the closed state, i.e., with non-deformed valve element 12, a possible deformation of the valve element 12 for the opening of the outlet valve 12 being indicated with a broken line.

Especially preferably, no nozzle and no other channel or the like is connected to the outlet valve 10 or to the valve element 12 thereof. Rather, the outlet valve 10 opens to the open air. In this way, after leaving the outlet valve 10, the liquid 2 can preferably be removed directly and used by a user (not shown).

The outlet valve 10 is preferably embodied such that it opens depending on the prevailing liquid pressure, particularly upon exceeding a predetermined minimum pressure. Especially preferably, this minimum pressure is greater than the foaming pressure at which the liquid 2 is self-foaming. In contrast, the dispensing pressure and thus the prevailing product or liquid pressure is then in turn greater than the minimum pressure (with open dispensing valve 4), so that the outlet valve 10 also opens for the purpose of the desired dispensing of liquid and generation or delivery of foam.

In the depicted example, the outlet valve 10 has a retention part 13 with a retention section 14 for fastening the valve element or as a counterpiece or valve seat for the valve element 12. Particularly, the retention section 14 forms a wall against which the valve element 12 rests and/or to which the valve element 12 is connected.

The outlet valve 10 has an outlet 15 through which the liquid 2 or a product formed from it can be delivered—particularly into the open air. The outlet 15 is preferably formed in or by the valve element 12 alone and/or through same.

Figure 3:
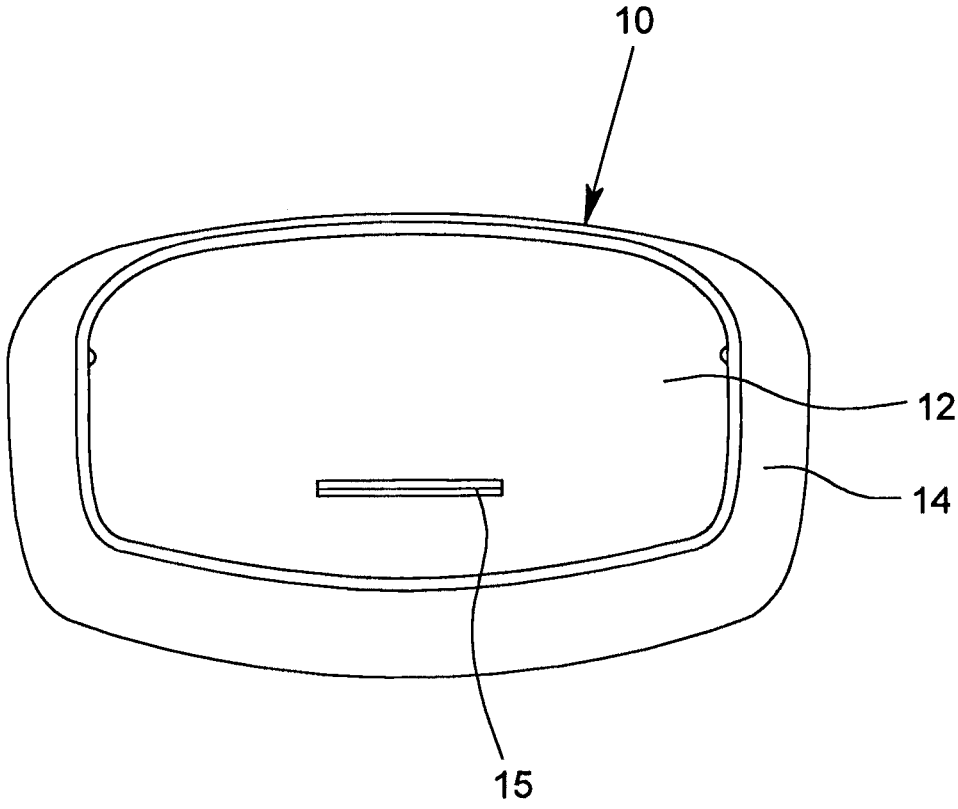
FIG. 3 shows a top view of the valve.

In particular, the outlet 15 is embodied as a through hole in the valve element 12. Preferably, the outlet 15 is embodied as a slit. As can be seen from the top view of the outlet valve 10 according to FIG. 3, the outlet 15 is particularly embodied as a straight slit according to an especially preferred modification.

However, the outlet 15 can also have any other shape and/or even be formed, if necessary, by several openings or through holes in the valve element 12.

The outlet 15 can be introduced, for example cut, subsequently into the valve element 12. Alternatively or in addition, the outlet 15 can also be directly shaped, formed or at least pre-shaped simultaneously during the manufacture of the valve element 12, especially preferably during the injection of the valve element 12.

Preferably, the outlet 15 is closed when the outlet valve 10 is closed—i.e., when the valve element 12 is lying flat or resting with its entire surface against the retention section 14 or when the valve element 12 is not deformed—particularly as a result of the wall of the valve element 12 surrounding the outlet 15, particularly an edge of the outlet 15 adjoining the retention section 14, lying flat so as to form a seal. Alternatively or in addition, the closing of the outlet 15 can also be brought about as a result of the outlet 15 resting on its inlet side on the retention section 14 or on the bearing surface or wall when the valve element 12 is not deformed, i.e., when the outlet valve 10 is closed.

To open the outlet valve 10, the valve element 12 is opened, preferably in a self-actuating manner, particularly by the pressure of the applied liquid 2 or of a product formed from it. In order to open, the valve element 12 is preferably deformed or lifted up from the retention section 14 in areas as indicated by broken lines in FIG. 2. This deformation occurs particularly in a deformation area 17. The outlet 15 is arranged within this deformation area 17.

The deformation of the valve element 12 preferably has the consequence that the outlet 15 is arched or opened, such that it is therefore already opened automatically as a result of the flat extension of the valve element 12 in the deformation area 17. Alternatively or in addition, this opening of the outlet 15 can be brought about or supported by the pressure of the applied liquid 2 or of a product formed by it.

As indicated schematically in FIG. 2, the outlet is able to expand from its inlet side facing the retention section 14 toward the outlet side. This expansion can be provided or implemented when the outlet valve 10 is open and/or closed. A desired delivery or spray characteristic can be achieved through the cross-sectional expansion toward the open end.

The outlet valve 10 preferably has an outlet channel 16 which is particularly formed in or by the retention part 13 or retention section 14. In particular, the outlet channel 16 ends in the retention section 14 and/or is covered on the outlet side by the valve element 12 and preferably also sealed on the outlet side when the outlet valve 10 is closed. The valve element 12 thus preferably seals an outlet opening 18 of the outlet channel 17 in the non-deformed state or when the outlet valve 10 is closed.

The outlet channel 16 preferably also ends within the deformation area 17 so that the outlet channel 16 can be opened or released on the outlet side when the valve element 12 is deformed. In particular, the pressure of the liquid 2 or of the product formed by it present in the outlet channel 16 upon actuation of the dispensing device 1 or of the dispensing head 6, and hence when the dispensing valve 4 is open, causes the valve element 10 to deform elastically or to be lifted from the retention section 14 as already mentioned above, particularly to arch outward as in the depicted example. As a result, the outlet channel 16 as well as the outlet 15 are opened, this opening the outlet valve 10.

When the outlet valve 10 is open, the liquid 2 or the product formed from it is able to flow or emerge from the outlet channel 16 between the valve element 12 and the retention section 14 to the outlet 15 and through same into the open air.

The valve element 12 is preferably planar or flat. The retention section 14 is preferably planar or flat and/or preferably forms a flat or substantially level bearing surface or wall for the valve element 12.

The main outlet direction of the outlet valve 10 preferably extends crossways or perpendicular to the preferred superficial extension of the valve element 12 and/or retention section 14.

The outlet valve 16 preferably extends crossways or perpendicular to the preferred superficial extension of the valve element 12 and/or retention section 14.

The outlet 15 is preferably arranged in a transversely offset manner with respect to the outlet channel 16, particularly with an offset 19. The offset 19 is preferably of such a size that the outlet 15 lies to the side next to the outlet opening of the outlet channel 16. What is achieved by this is that, when the outlet valve 10 is open, the liquid 2 or product formed from it emerging from the outlet channel 18 must first be diverted preferably by about 90° and then is diverted again by about 90° to flow into the outlet 15 and emerge. A double diversion therefore preferably occurs in the outlet valve 10.

The main outlet direction of the outlet valve 10 or outlet 15 on the one hand and the main direction of extension of the outlet channel 16 preferably run at least substantially parallel to each other.

Preferably, the outlet channel 16 is tapered on the outlet side or with its outlet opening toward the valve element 12. In this way, the size of the deformation area 17 can be reduced or minimized.

In the depicted example, the outlet channel 16 or the outlet opening 18 thereof has a preferably at least substantially round cross section. However, the outlet opening of the outlet channel 16 in particular can also have any other cross section, for example a flat or half moon-shaped cross section, particularly in order to enable an especially compact arrangement and/or a small deformation area 17.

The outlet valve 10 or the retention part 13 thereof is preferably provided with a retention area 20 for fastening or connecting the outlet valve 10 to the dispensing device 1 or the dispensing head 6. In the depicted example, the retention area 20 is preferably muff-like or tubular, particularly with the outlet channel 16 being formed by the retention area 20 or proceeding into it. The retention area 20 is preferably molded in a single piece on the retention part 13.

The retention area 20 can preferably be plugged into the receiving notch 11. Especially preferably, the receiving notch 11 is ring-like, such that the retention area 20 can be guided or inserted into this annular space. However, other constructive solutions are also possible.

The dispensing device 1 or the dispensing head 6 is preferably embodied such that the dispensing head 6 or an actuating section 21 preferably disposed or formed above can be depressed and/or tilted, preferably manually. The depressing or tilting results in the opening of the dispensing valve 4, particularly through the corresponding action of the connecting section 8 on the dispensing valve 4.

In the depicted example, the dispensing head 6 or the actuating section 20 can preferably be tilted on an axis running substantially perpendicular to the drawing plane of FIG. 1, particularly under elastic deformation of a connecting section.

When the dispensing valve 4 is open, the preferably pressurized liquid 2 in the reservoir or container 3 is then able to flow into the delivery channel 7, for example via riser tube 22 (FIG. 1) and the opened dispensing valve 4. For example, an at least initial foaming of the liquid 2 then occurs in the delivery channel 7. Optionally, a foaming device—not shown here—can also be provided (alternatively or in addition). For example, the liquid 2 or the foam can be foamed by a screen (not shown) and/or through feeding of gas or air (alternatively or in addition).

The pressurized liquid 2 or product formed by it is able to flow via the delivery channel 7 and connecting channel 9 to the outlet valve 10, particularly into the outlet channel 16. The pressure then acting on the outlet valve 10 brings about an opening of the outlet valve 10, resulting in the desired output of the liquid 2 or of the product formed from it. As a result of the prevailing or applied pressure in the channel 7, 9, 18 when the dispensing valve 4 is opened, the outlet valve 10 preferably opens in a self-actuating manner.

Upon releasing of the actuating section 21 or dispensing head 6, a return to the initial position or non-actuated position occurs preferably as a result of corresponding restorative forces, optionally by means of an additional returning means such as a return spring. Accordingly, the dispensing valve 4 is able to close again. Consequently, the pressure acting on the outlet valve 10 drops again below the opening pressure of the outlet valve 10 and the outlet valve 10 or the valve element 12 thereof preferably closes again automatically.

The dispensing of liquid or generation of foam ends when the liquid pressure or dispensing pressure drops again below the minimum pressure, resulting in the closing again of the outlet valve 10—particularly as a result of the elastic return of the valve element 12. This is the case when the dispensing valve 4 closes again—particularly through the releasing and automatic return of the dispensing head 6 or actuating section 21—and the pressure in the channel 7, 9, 16 drops below the minimum pressure. The closed or closing outlet valve 10 prevents liquid 2 or product such as foam or the like present in the channel 7 from continuing to emerge or foaming out in an undesired manner.

One particular advantage of the outlet valve 10 is that, besides preventing the liquid 2 from continuing to emerge, particularly continuing to foam, cleaning is also made very easy for the user, since the outlet valve 10 preferably forms a clean or easy-to-clean outlet 15.

In the depicted example, the dispensing of liquid preferably occurs substantially crossways, particularly perpendicular, to the direction of depression or opening of the dispensing valve 4 and/or at least substantially horizontal or crossways to the longitudinal direction of the container 3.

As mentioned above, the valve element 12 is not connected in the deformation area 17 to the retention section 14 below it.

However, the valve element 12 is connected to the retention section 14 in a preferably fixed and/or non-detachable, particularly in a liquid-tight and, optionally, gas-tight manner in a connection area laterally adjacent to the deformation area 17. Preferably, the valve element 12 is connected over its entire surface in the connection area 23 to the retention section 14 below it. The connection area 23 encloses the deformation area 17 preferably in ring-like fashion and/or encloses the deformation area preferably completely.

The valve element 12 is preferably connected solidly to the retention section 14 or retention part 13 through injection in the connection area 23. In principle, however, the valve element 12 can also be non-detachably connected in another suitable manner to the retention section 14 and/or held against same in a sealing manner. For example, the valve element 12 can also be adhered or welded to the retention section 14. It is also possible for the valve element 12 to be injected around the retention section 14, thus connecting the valve element 12 to the retention section 14.

According to a preferred aspect, the valve element 12 preferably rests evenly or over its entire surface on the retention section 14.

The retention part 13 or the retention section 14 thereof is made of a first material, particularly a relatively rigid plastic material. A polyolefin, particularly PP (polypropylene) or PE (polyethylene), is preferably used.

The valve element 12 is made of a second material and/or by means of injection. In particular, the second material is an elastomer and/or a thermoplast. Preferably, a TPE (thermoplastic elastomer) or TPV or the like is used. Particularly, it is a flexible material. The second material is particularly flexible or softer than the first material. This is particularly desirable, since the valve element 12 formed from it is to have a certain elastic deformability and/or flexibility in contrast to the retention section 14.

Accordingly, the first material and the second material are preferably different, differing particularly with respect to their composition and/or characteristics. In principle, however, it is also possible to use the same or similar material.

Preferably, a combination of materials is selected for the first material and the second material that enables the two materials to be joined solidly together preferably directly through injection. Especially preferably, such a solid joining of the two materials can be achieved without pretreatment, adhesion promoters, processing or the like.

Especially preferably, the injection of the valve element 12 on the retention part 13 or the retention section 14 is performed particularly by means of so-called "bi-injection," in which one material (the first material) is first injected into an injection mold and then the other material (the second material) is injected into the same injection mold against the previously injected material. In principle, however, it is also possible for the two materials to fundamentally be injected almost simultaneously into the same injection mold.

By injecting the two materials against each other, the desired solid connection is achieved in the connection area 23. Preferably, no other measures are necessary for the joining of the two materials or components (here the retention section 14 and the valve element 12) in the desired connection area 23 in order to achieve the desired strength, chemical bond, chemical resistance and/or seal. In principle, however, other measures such as pressing, clamping, welding or the like can also be used alternatively or in addition.

Figure 4:
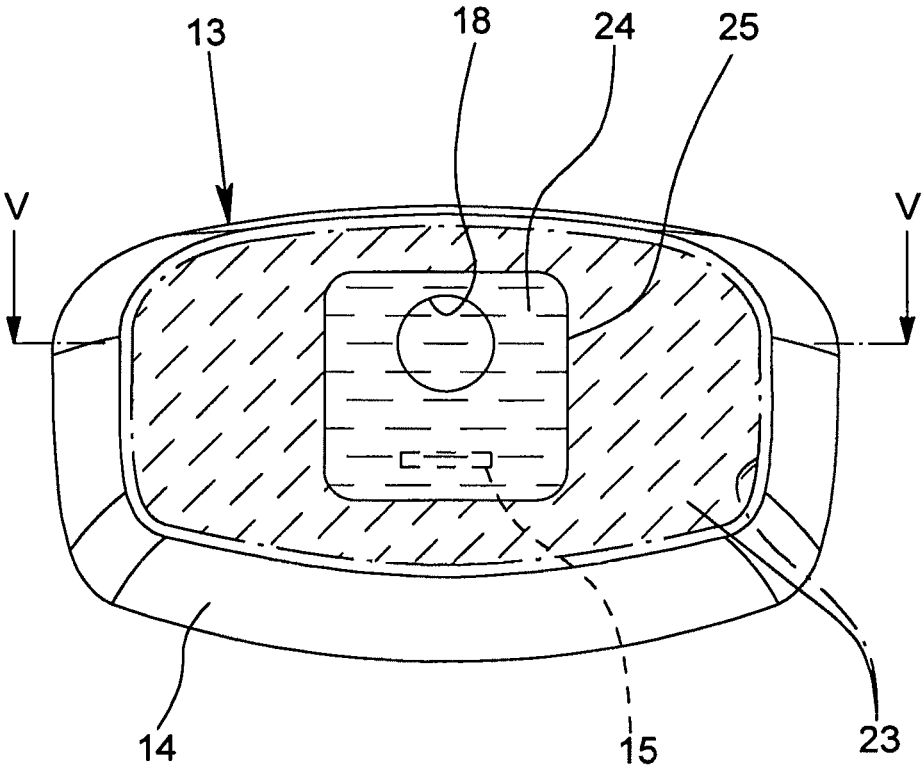
FIG. 4 shows a top view of a retention part of the valve without valve element.

FIG. 4 shows a top view of the retention part or retention section 14. Indicated by diagonal hatching is the connection area 23 in which the valve element 12 (not shown in FIG. 4) is connected flatly to the retention section 14.

FIG. 4 also shows a pretreated area 24 that is particularly formed or determined by a film 25 as explained in further detail below. The pretreatment area 24 particularly establishes the deformation area 17 for the valve element 12, since the valve element 12 does not connect to the retention section 14 in the pretreated area 24.

The pretreatment area 24 comprises here the outlet channel 18 and the outlet opening thereof. The outlet 15 also preferably lies within the pretreatment area 24, as indicated in FIG. 4 with a broken line.

The connection area 23 preferably encloses the pretreatment area 24 completely.

Figure 5:
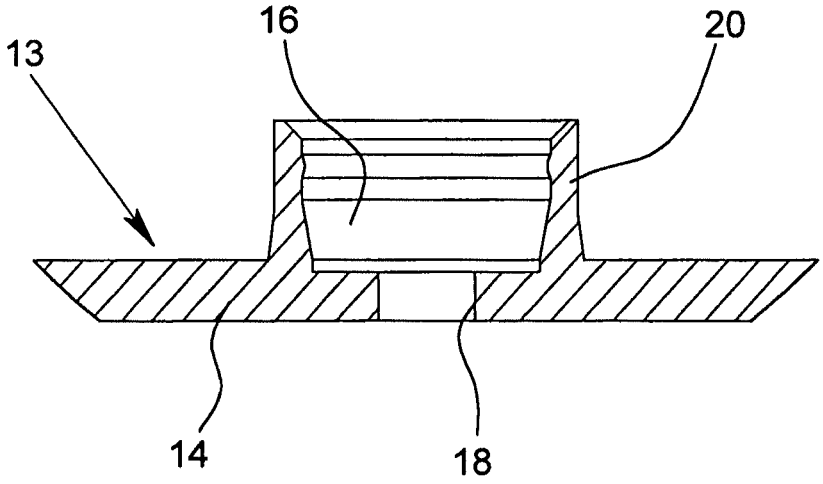
FIG. 5 shows a section of the retention part according to FIG. 4 along the line V-V.

In a sectional view of FIG. 4 along the V-V line, FIG. 5 shows the retention part 13 without valve element 12 and without film 25.

According to one aspect of the present invention, a material—in this case the first material—particularly the retention section 14, is pretreated in an area 24 in order to prevent the two materials and hence the two components from joining together in this area 24. In the described embodiments, what is thus achieved is that the valve element 12 is not connected to the retention section 14 in the pretreated 24 or is able to detach from the retention section 14 exclusively or at least in the pretreated area 24. In particular, the area 24 therefore corresponds to the deformation section 17 or vice versa. However, the pretreatment area 24 can also be larger than the deformation area 17.

For instance, one thing that can be achieved according to the invention is that the valve element 12, which is injected (or, alternatively, glued) directly against the retention section 14 and consequently connected solidly to same, does not connect to same in the pretreated area 24 and/or can be detached or lifted off from same exclusively in the pretreated area 24.

The proposed pretreatment can also be understood as a kind of passivation or application of a separating layer which prevents a connection between the first and second materials or of the two components 12 and 14 in the pretreated area 24.

Preferably, the first material is pretreated through the application of a coating, intermediate layer, or film 25, as indicated in FIG. 4 in the schematic view of the retention section 14 without valve element 12. In particular, an embossing film or heat seal film is used for the pretreatment which covers the first material in the desired area 24 and/or is connected particularly by means of pressure and/or heat to the first material at least in areas.

Depending on the process flow, the connection to the film 25 or another covering to the first material or retention section 14 can be achieved and/or promoted directly in the injection mold and/or as a result of the existing residual heat after injection and/or by means of additional and targeted heat (e.g., infrared radiation) and/or pressure.

Alternatively, however, it is also possible in principle to allow the covering or film 25 or the like to adhere only slightly or even lie loosely on the area 24 to be pretreated.

As needed, the covering or film 25 can also be positioned in the desired manner by means of retention pins or the like (not shown) on the retention section 14 or the first material and, optionally, also held or fixed during the injection of the second material or valve element 12.

Especially preferably, the coating, intermediate layer or film 25 consists of an additional material and/or of different materials in order to achieve a connection to the first material or retention section 14 and/or to prevent a connection to the second material or valve element 12.

As needed, the coating or intermediate layer can also be applied by means of applied pressure, gluing, or in another suitable manner.

If the coating in the pretreatment area 24 consists of or is formed by paint or another liquid, it can also be applied to the area 24 to be pretreated in any suitable manner for pretreatment and fall within the scope of the present invention.

Subsequently, the second material or valve element 12 is preferably injected directly against the first material or the retention section 14 and thus connected to same. In principle, another means of connection, for example gluing, welding, or the like, is also worthy of consideration. Preferably, the pretreated area 24 is completely covered or enclosed by the second material, with the exception of an outlet and/or inlet, if provided.

The covering or film 25 is opened in the area of the outlet opening of the outlet channel 16, preferably mechanically, during the manufacture and/or by the liquid 2 at the time of the first output. What is achieved by virtue of the proposed pretreatment in the area 24 is that there occurs no connection or (solid) adhesion of the second material or valve element 12 to the first material or retention section 14 or on the coating, intermediate layer or film 25. Rather, the second material or valve element 12 is able to lift off again or detach—preferably exclusively or at least—in the pretreated area 24.

Especially preferably, a blank is first injected out of the first material. Then the film 25 is embossed in the desired pretreatment area 24—particularly by means of a hot stamping method—that is not to form a bond with another component or with a soft component. Subsequently, the soft or other component is injected onto the first component or hard component, particularly such that the coating, intermediate layer, or film 25 is completely included in the mold at least substantially. Instead of the preferred hot stamping method, an impressing or insertion of a corresponding intermediate element such as an intermediate layer or film 25 can be done to achieve the desired pretreatment in the area 24.

In particular, it is possible and provided for to inject the second material directly and with its full surface against the first material or the surface formed by same or the retention section 14, or to apply it in another manner. As a result of the pretreatment only in areas, an adhesion or connection then preferably only occurs outside of the pretreated area 24, i.e., in the connection area 23. The valve element 12 is therefore able to detach again, for example to be lifted off or the like, from the first material in the pretreated area 24, particularly in order to form a fluid connection for the liquid 2 or a product formed from it such as a foam, or to form a valve. This enables very easy manufacturing and the establishing of desired connection areas 23 in a simple manner.

It should be noted as a matter of principle that, in the present invention, the term "solid" connection is preferably to be understood in terms of a chemical and/or tight connection.

As needed, the dispensing valve 4 can also be a dosing valve or other valve device.

1 Dispensing device
2 Liquid
3 Container
4 Dispensing valve
5 Housing part
6 Dispensing head
7 Delivery channel
8 Connecting section
9 Connecting channel
10 Outlet valve
11 Receiving notch
12 Valve element

13 Retention area
14 Retention section
15 Outlet
16 Outlet channel
17 Deformation area
18 Outlet opening
19 Offset
20 Retention area
21 Actuating section
22 Riser tube
23 Connection area
24 Pretreatment area
25 Film

The invention claimed is:

1. Valve for a liquid comprising:
a valve element that is elastically deformable in a deformation area for opening of the valve;
a retention section associated with the valve element; and
an outlet,
wherein the valve element is non-detachably connected to the retention section around the deformation area or is held in a sealing manner against or on the retention section,
wherein the valve element rests flatly on the retention section and covers an outlet channel,
wherein the outlet is formed through the valve element, and
wherein the valve element is injected or glued directly against the retention section and is connected to the retention section.

2. Valve as set forth in claim 1, wherein the outlet is slit-like.

3. Valve as set forth in claim 1, wherein the outlet widens starting from the side facing the retention section in the direction of the other side of the valve element, even when the valve is closed.

4. Valve as set forth in claim 1, wherein the retention section is pretreated in an area forming the deformation area wherein the valve element is not connected to the retention section in the pretreated area or is detachable from the retention section in the pretreated area.

5. Valve as set forth in claim 4, wherein the retention section is pretreated through the application of a coating, intermediate layer, or film.

6. Valve as set forth in claim 5, wherein the coating, intermediate layer, or film is connected solidly to the retention section.

7. Valve as set forth in claim 5, wherein the coating, intermediate layer, or film is not connected to the valve element.

8. Valve as set forth in claim 1, wherein the valve element is connected to the retention section in a ring-shaped or circumferential connection area.

9. Valve as set forth in claim 1, wherein the outlet is offset laterally or crossways to the outlet channel, and the outlet does not cover the outlet channel.

10. Valve as set forth in claim 1, wherein the main outlet direction of the outlet runs at least substantially parallel to the main direction of extension of the outlet channel.

11. Valve as set forth in claim 1, wherein the main outlet direction of the outlet runs crossways or perpendicular to the superficial extension of the valve element or retention section.

12. Valve as set forth in claim 1, wherein one or more of the valve element and the retention section are at least substantially flat, plate-like, or level.

13. Dispensing device for a cosmetic liquid, wherein the dispensing device has or forms a dispensing head, wherein the dispensing head has an outlet valve for the liquid or a product formed from it,
wherein
the outlet valve is installed as a prefabricated assembly and comprises:
a valve element that is elastically deformable in a deformation area for opening of the valve;
a retention section associated with the valve element; and
an outlet,
wherein the valve element is non-detachably connected to the retention section around the deformation area or is held in a sealing manner against or on the retention section,
wherein the valve element rests flatly on the retention section and covers an outlet channel,
wherein the outlet is formed through the valve element, and
wherein the outlet of the valve element is covered by the retention section in the closed state of the valve.

14. Dispensing device as set forth in claim 13, wherein the dispensing device has a container with the liquid, particularly a container that is or can be pressurized, or can be connected to same.

15. Dispensing device as set forth in claim 13, wherein the valve is accommodated or held in the delivery head in a clamping or locking manner.

16. Valve as set forth in claim 1, wherein the valve is for a delivery head of a dispensing device.

17. Valve as set forth in claim 1, wherein the outlet channel is formed in or by the retention section.

18. A valve for a liquid comprising:
a valve element that is elastically deformable in a deformation area for opening of the valve;
a retention section associated with the valve element; and
an outlet,
wherein the valve element is non-detachably connected to the retention section around the deformation area or is held in a sealing manner against or on the retention section,
wherein the valve element rests flatly on the retention section and covers an outlet channel,
wherein the outlet is formed through the valve element, and
wherein the retention section is pretreated in an area such that the valve element is not connected to the retention section in the pretreated area and is detachable from the retention section in the pretreated area.

19. Valve as set forth in claim 18, wherein the outlet is slit-like.

20. Valve as set forth in claim 18, wherein the outlet widens starting from the side facing the retention section in the direction of the other side of the valve element, even when the valve is closed.

21. Valve as set forth in claim 18, wherein the retention section is pretreated in an area forming the deformation area such that the valve element is not connected to the retention section in the pretreated area or is detachable from same in the pretreated area.

22. Valve as set forth in claim 21, wherein the retention section is pretreated through the application of a coating, intermediate layer, or film.

23. Valve as set forth in claim 22, wherein the coating, intermediate layer, or film is connected solidly to the retention section.

24. Valve as set forth in claim 22, wherein the coating, intermediate layer, or film is not connected to the valve element.

25. Valve as set forth in claim 18, wherein the outlet is offset laterally or crossways to the outlet channel and the outlet does not cover the outlet channel.

26. Valve as set forth in claim 18, wherein the main outlet direction of the outlet runs at least substantially parallel to the main direction of extension of the outlet channel.

27. Valve as set forth in claim 18, wherein the main outlet direction of the outlet runs crossways or perpendicular to the superficial extension of the valve element or retention section.

28. Valve as set forth in claim 18, wherein one or more of the valve element and the retention section are at least substantially flat, plate-like, or level.

29. Valve as set forth in claim 18, wherein the retention section is pretreated in an area forming the deformation area.

30. A valve for a liquid comprising:

a valve element that is elastically deformable in a deformation area for opening of the valve;

a retention section associated with the valve element; and an outlet, wherein the valve element is non-detachably connected to the retention section around the deformation area or is held in a sealing manner against or on the retention section, wherein the valve element rests flatly on the retention section and covers an outlet channel, wherein the outlet is formed through the valve element, and wherein the outlet of the valve element is covered by the retention section in the closed state of the valve.

31. Valve as set forth in claim 30, wherein the outlet is slit-like.

32. Valve as set forth in claim 30, wherein the outlet widens starting from the side facing the retention section in the direction of the other side of the valve element, even when the valve is closed.

33. Valve as set forth in claim 30, wherein the outlet is offset laterally or crossways to the outlet channel and the outlet does not cover the outlet channel.

34. Valve as set forth in claim 30, wherein the main outlet direction of the outlet runs at least substantially parallel to the main direction of extension of the outlet channel.

35. Valve as set forth in claim 30, wherein the main outlet direction of the outlet runs crossways or perpendicular to the superficial extension of the valve element or retention section.

36. Valve as set forth in claim 30, wherein the valve element and/or the retention section is or are at least one of the valve element and retention section is substantially flat, plate-like, or level.

37. Valve as set forth in claim 13, wherein the outlet is slit-like.

38. Valve as set forth in claim 13, wherein the outlet widens starting from the side facing the retention section in the direction of the other side of the valve element, even when the valve is closed.

39. Valve as set forth in claim 13, wherein the valve element is injected or glued directly against the retention section and is particularly connected to same as a result.

40. Valve as set forth in claim 13, wherein the retention section is pretreated in an area forming the deformation area such that the valve element is not connected to the retention section in the pretreated area or is detachable from same in the pretreated area.

41. Valve as set forth in claim 13, wherein the outlet is offset laterally or crossways to the outlet channel, such that the outlet does not cover the outlet channel.

42. Valve as set forth in claim 13, wherein the main outlet direction of the outlet runs at least substantially parallel to the main direction of extension of the outlet channel.

43. Valve as set forth in claim 13, wherein the main outlet direction of the outlet runs crossways or perpendicular to the superficial extension of the valve element or retention section.

44. Valve as set forth in claim 13, wherein one or more of the valve element and the retention section are at least one of substantially flat, plate-like, or level.

* * * * *